US007554434B1

(12) United States Patent
Gifford et al.

(10) Patent No.: US 7,554,434 B1
(45) Date of Patent: Jun. 30, 2009

(54) ELECTRONIC INDICATOR SYSTEM FOR MEDICINE BOTTLE

(76) Inventors: Barbra K. Gifford, 17596 Highway 16, Siloam Springs, AR (US) 72761; Joseph D. Gifford, 17596 Highway 16, Siloam Springs, AR (US) 72761

( * ) Notice: Subject to any disclaimer, the term of this patent is extended or adjusted under 35 U.S.C. 154(b) by 310 days.

(21) Appl. No.: 11/725,490

(22) Filed: Mar. 19, 2007

(51) Int. Cl.
*G08B 1/00* (2006.01)
*G04F 8/00* (2006.01)
*B65D 39/00* (2006.01)

(52) U.S. Cl. ..... 340/309.16; 340/309.7; 368/1; 368/10; 215/230

(58) Field of Classification Search ..... 340/309.16, 340/309.7
See application file for complete search history.

(56) References Cited

U.S. PATENT DOCUMENTS

| | | | | |
|---|---|---|---|---|
| 4,011,829 | A | 3/1977 | Wachsmann | |
| 4,528,933 | A | 7/1985 | Allen | |
| 4,666,051 | A | 5/1987 | Trick | |
| 5,009,338 | A | 4/1991 | Barker | |
| 5,815,586 | A * | 9/1998 | Dobbins | 381/124 |
| 5,852,590 | A * | 12/1998 | de la Huerga | 368/10 |
| 6,667,936 | B1 * | 12/2003 | Ditzig | 368/10 |
| 2006/0071011 | A1 * | 4/2006 | Varvarelis et al. | 221/9 |

* cited by examiner

*Primary Examiner*—Donnie L Crosland

(57) ABSTRACT

An indicator system for use on a medicine bottle to indicate the time and date of the last dosage. The system includes means for registering time and date when the bottle is opened and then closed.

2 Claims, 1 Drawing Sheet

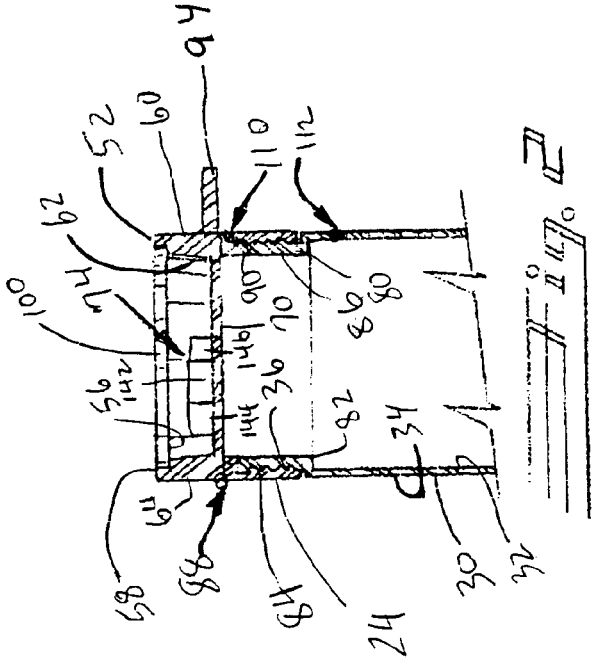
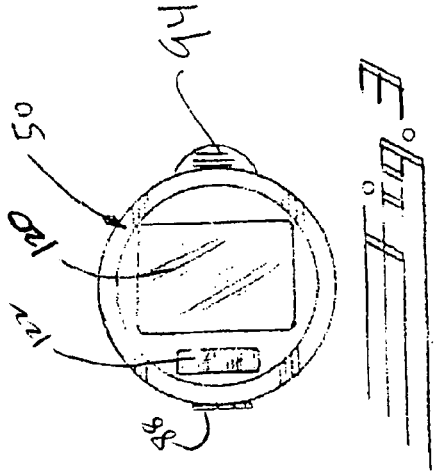
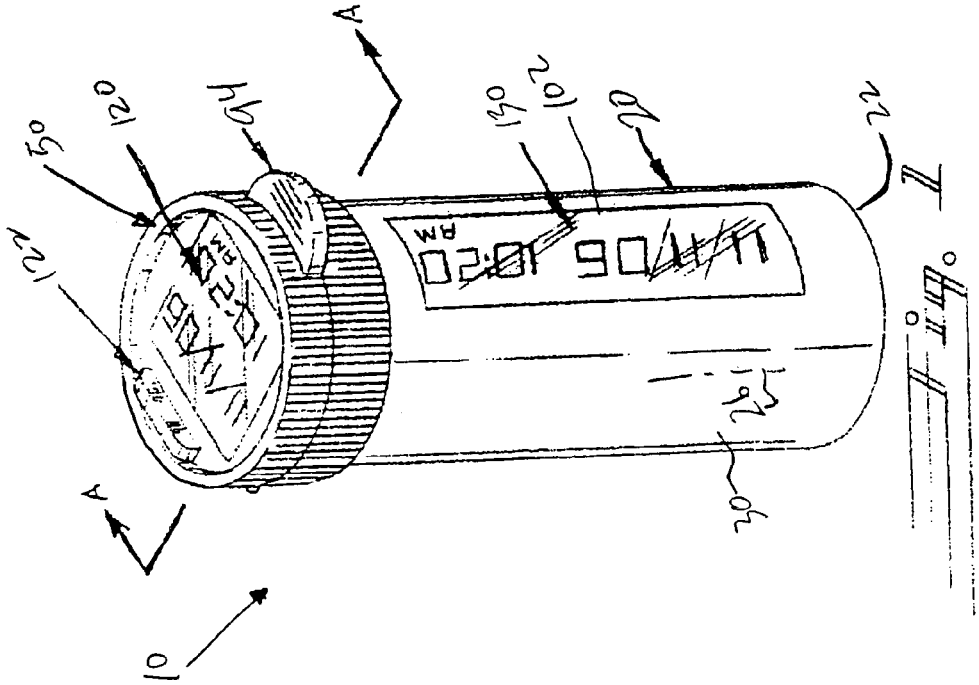

ELECTRONIC INDICATOR SYSTEM FOR MEDICINE BOTTLE

TECHNICAL FIELD OF THE INVENTION

The present invention relates to the general art of dispensing containers, and to the particular field of dispensing containers for medicine.

BACKGROUND OF THE INVENTION

Present medical drugs have a predetermined therapeutic range in which the effects of taking the drug are beneficial. Under utilization of a drug may endanger the user with the drug's side effects without reaching levels necessary for a therapeutic action. On the other hand, over utilization may cause side effects or toxicity to a much greater extent than any possible benefit. Thus is critically important that a patient follow prescribed directions on medications, yet, frequently patients forget whether they have taken medication and either omit doses or repeat them. One of the major factors in a patient's non-compliance with the taking of medication is the problem of not remembering whether the medication was taken at the last scheduled dosage time.

This problem is particularly severe for elderly patients who are generally beset with multiple ailments requiring numerous drugs and directions. The fading memory and confusion that come with age further compound the problem. Oftentimes, elderly patients could well lead independent self-sufficient lives but for their inability to follow a therapeutic regimen necessary to their health and well-being. Caps of the "reminder" type will be an important adjunct in drug therapy as the number of elderly people increases and new potent drugs are utilized.

A considerable number of pill-timing schemes have been used to solve the problem of reminding a patient to take a dose of medicine or reminding him he has already taken that dose. The most used ones involve some scheme of compartmentalization of the necessary medication, such that the pills are placed in compartments labeled as to day, to dose number or time of day, or serially numbered. These devices are reasonably satisfactory if a responsible person is available and has the time and patience to fill the compartments properly.

Therefore, there is a need for a pill storage and dispensing device that will remember a pill taking regimen as well as remind a user that it is time to take medicine.

SUMMARY OF THE INVENTION

These, and other, objects are achieved by an indicator system for use on a medicine bottle to indicate the time and date of the last dosage. The system includes means for registering time and date when the bottle is opened and then closed. The system can also include an alarm.

BRIEF DESCRIPTION OF THE DRAWING FIGURES

FIG. 1 is a perspective view of a perspective view of a medicine bottle having thereon the indicator system embodying the present invention.

FIG. 2 is a view taken along line A-A of FIG. 1.

FIG. 3 is a top plan view of the bottle shown in FIG. 1.

DETAILED DESCRIPTION OF THE PREFERRED EMBODIMENT OF THE INVENTION

Other objects, features and advantages of the invention will become apparent from a consideration of the following detailed description and the accompanying drawings. Referring to the figures, it can be understood that the present invention is embodied in a medicine container 10 which alerts a use when it is time to take medicine and then maintains a record of when medicine was last taken.

Container 10 comprises a container body 20 which includes a first end 22 which is a bottom end when the body is in use, a second end 24 which is a top end when the body is in use, and a longitudinal axis 26 which extends between first end 22 and second end 24 of the body. A sidewall 30 connects first end 22 to second end 24. Sidewall 30 has an inner surface 32 and an outer surface 34. A screw thread 36 is located on inner surface 32 of the sidewall of the body near the second end of the body.

A container cap 50 is mounted on second end 24 of the body when in use and includes a first surface 52 which is a top surface when the cap is in use, with first surface 52 having an inner surface 56 and an outer surface 58. A sidewall 60 extends from first surface 52 of the cap and has an inner surface 62 and an outer surface 64 and an end 66 which is spaced apart from top surface 52 of the cap. A mid wall 70 is mounted on inner surface 56 of the sidewall of the cap and is spaced apart from inner surface 56 of top surface 52 of the cap. A chamber 74 is defined by inner surface 56 of the top wall of the cap and mid wall 70 and inner surface 62 of the sidewall of the cap.

A skirt 80 has a rim 82, an outer surface 84 and an inner surface 86. The skirt and the rim of the skirt are located adjacent to inner surface 32 of the sidewall of the body when the cap is in place on the body as can be understood from FIG. 2. A hinge 88 connects the skirt to the sidewall of the cap. A screw thread 90 is defined on outer surface 84 of the skirt of the cap and extends from rim 82 of the skirt to adjacent to mid wall 70 of the cap and threadably engages the screw thread on the container body when the cap is in use to securely mount the cap on the body. An opening tab 94 is mounted on the outer surface of the sidewall. The opening tab is located to be co-planar with the mid wall of the cap. A first translucent window 100 is located in the top surface of the cap adjacent to the chamber defined in the cap and a second translucent window 102 located in the sidewall of the body.

A first proximity sensor element 110 is positioned in the sidewall of the cap and a second proximity sensor element 112 is located in the sidewall of the body. The first and second proximity sensors are located closely adjacent to each other when the cap is in place on the body and are separated from each other when the cap is removed from the body. An alarm time and date display 120 is located to be visible in the first translucent window and displays preset time and preset date when a user is to take medicine. Control buttons 122 are located on the top surface of the cap and are used to set the alarm display.

A record time and date display 130 is located in the second translucent window and is associated with the first and second proximity sensor elements to display the time and date the cap was last removed from the body as an indication of when medicine was last taken. A circuit control unit 140 is located in the chamber in the cap and includes an alarm circuit 142 which connects the alarm display with the alarm time and date display. A record circuit 144 connects the first and second proximity sensor elements with the record time and date display. A third circuit 146 connects the control buttons to the alarm circuit.

Whenever the cap is removed from the body and then replaced, the record time and date circuits are activated and the record time and date displays are changed appropriately whereby a user will know when the medicine was last taken.

The alarm circuit will alert the user when it is time to take medicine. The time and date circuits of both the alarm system and the record system can be reset and re-activated as needed.

It is understood that while certain forms of the present invention have been illustrated and described herein, it is not to be limited to the specific forms or arrangements of parts described and shown.

What is claimed is:

1. A medicine container comprising:

A) a container body which includes (1) a first end which is a bottom end when the body is in use, (2) a second end which is a top end when the body is in use, (3) a longitudinal axis which extends between the first end of the body and the second end of the body, (4) a sidewall which connects the first end to the second end, the sidewall of the body having an inner surface and an outer surface, and (5) a screw thread on the inner surface of the sidewall of the body near the second end of the body;

B) a container cap which is mounted on the second end of the body when in use and which includes (1) a first surface which is a top surface when the cap is in use, the first surface of the cap having an inner surface and an outer surface, (2) a sidewall which extends from the first surface of the cap, the sidewall of the cap having an inner surface, an outer surface, and an end which is spaced apart from the top surface of the cap, (3) a mid wall which is mounted on the inner surface of the sidewall of the cap and which is spaced apart from the inner surface of the top surface of the cap, (4) a chamber defined by the inner surface of the top wall of the cap and the mid wall and the inner surface of the sidewall of the cap, (5) a skirt which has a rim, an outer surface and an inner surface, the skirt and the rim of the skirt being located adjacent to the inner surface of the sidewall of the body when the cap is in place on the body, (6) a hinge connecting the skirt to the sidewall of the cap, (6) a screw thread defined on the outer surface of the skirt of the cap, the screw thread on the skirt of the cap extending from the rim of the skirt to adjacent to the mid wall of the cap and threadably engaging the screw thread on the container body when the cap is in use, and (6) an opening tab on the outer surface of the sidewall, the opening tab being located to be co-planar with the mid wall of the cap;

C) a first translucent window located in the top surface of the cap adjacent to the chamber defined in the cap;

D) a second translucent window located in the sidewall of the body;

E) a first proximity sensor element in the sidewall of the cap;

F) a second proximity sensor element in the sidewall of the body, the first and second proximity sensors being located closely adjacent to each other when the cap is in place on the body and being separated from each other when the cap is removed from the body;

G) an alarm time and date display in the first translucent window which displays preset time and preset date when a user is to take medicine;

H) control buttons on the top surface of the cap which are used to set the alarm display;

I) a record time and date display in the second translucent window which is associated with the first and second proximity sensor elements to display the time and date the cap was last removed from the body as an indication of when medicine was last taken; and J) a circuit control unit in the chamber in the cap and including (1) an alarm circuit which connects the alarm display with the alarm time and date display, (2) a record circuit which connects the first and second proximity sensor elements with the record time and date display, and (3) a third circuit which connects the control buttons to the alarm circuit.

2. A medicine container comprising:

A) a container body which includes

B) a container cap which is mounted on the body to close the body when in use;

C) a first translucent window located in the cap;

D) a second translucent window located in the body;

E) a first proximity sensor element in the cap;

G) a second proximity sensor in the body, the first and second proximity sensors being located closely adjacent to each other when the cap is in place on the body and being separated from each other when the cap is removed from the body;

F) an alarm time and date display in the first translucent window which displays preset time and preset date when a user is to take medicine;

G) control buttons on the top surface of the cap which are used to set the alarm display;

H) a record time and date display in the second translucent window which is associated with the first and second proximity sensors to display the time and date the cap was last removed from the body as an indication of when medicine was last taken; and I) a circuit control unit in the chamber in the cap and including (1) an alarm circuit which connects the alarm display with the alarm time and date display, (2) a record circuit which connects the first and second proximity sensors with the record time and date display, and (3) a third circuit which connects the control buttons to the alarm circuit.

* * * * *